US008557089B2

(12) United States Patent
Schutt

(10) Patent No.: US 8,557,089 B2
(45) Date of Patent: Oct. 15, 2013

(54) CATHODIC PROTECTION SYSTEM FOR MARINE APPLICATIONS

(75) Inventor: William R. Schutt, Doylestown, PA (US)

(73) Assignee: Matcor, Inc., Chalfont, PA (US)

( * ) Notice: Subject to any disclaimer, the term of this patent is extended or adjusted under 35 U.S.C. 154(b) by 150 days.

(21) Appl. No.: 13/366,689

(22) Filed: Feb. 6, 2012

(65) Prior Publication Data

US 2012/0305386 A1 Dec. 6, 2012

Related U.S. Application Data

(60) Provisional application No. 61/491,363, filed on May 31, 2011.

(51) Int. Cl.
*C23F 13/06* (2006.01)
*C23F 13/18* (2006.01)

(52) U.S. Cl.
USPC ..... 204/196.3; 204/196.01; 204/196.38; 405/211.1

(58) Field of Classification Search
USPC ..... 204/196.3, 196.38, 196.01
See application file for complete search history.

(56) References Cited

U.S. PATENT DOCUMENTS 1,991,236 A * 2/1935 Van De Graaff ..... 310/308
3,516,917 A 6/1970 Maurin
4,401,540 A 8/1983 Tatum et al.
4,609,307 A * 9/1986 Guy et al. ..... 205/731
4,614,574 A * 9/1986 Bussell ..... 204/196.36

OTHER PUBLICATIONS

Lewis, E., et al., "Improvements in Offshore Cathodic Protection Retrofits", Corrosion Control 007, Paper 034, pp. 1-10, XP009164430, Dec. 4, 2007-Dec. 5, 2007.
Seubert, M.K., "Design Parameters for Offshore Well Casing Cathodic Protection", Proceedings: 7th Middle East Oil Show, Mar. 11, 1989-Mar. 14, 1989, XP009164416, pp. 81-86.
Franco, Robert J., et al., "Aft Anode Sled Failure at a Floating Production Unit Hull", NACE International Corrosion 2007 Conference & Expo, Paper No. 07075, XP-002686789, pp. 1-15, Mar. 2007.
Pierson, P., et al., "A new Equation for Potential Attenuation and Anode Current Output Projection for Cathodically Polarized Marine Pipelines and Risers", Corrosion, vol. 56, Apr. 2000), pp. 350-360, XP009164414.

(Continued)

*Primary Examiner* — Harry D Wilkins, III
*Assistant Examiner* — Bryan D. Ripa
(74) *Attorney, Agent, or Firm* — Caesar, Rivise, Bernstein, Cohen & Pokotilow, Ltd.

(57) ABSTRACT

An anode assembly for an impressed current cathodic protection system is disclosed. The anode assembly is arranged to protect a structure in a body of water. It includes an anode, an anode support and a base and is arranged to be electrically connected to the cathodic protection system. The base is a weighted member. The anode comprises a spherical hollow titanium body coated with a mixed metal oxide and filled with a non-conductive material. The anode support is an elongated titanium tube that projects upward from the base. The anode is welded on the top portion of the support to be disposed above the bed of the body of water. The anode assembly is connected to the cathodic protection system by an electrical connector mounted in a box.

25 Claims, 2 Drawing Sheets

(56) References Cited

OTHER PUBLICATIONS

Surkein, Michael B., et al., "Corrosion Protection—Robust Retrofit of a Gravity Based Production Structure in Frozen Arctic High Scour Conditions", 21st International Offshore and Polar Engineering Conference, ISOPE—2011, Jun. 19, 2011-Jun. 24, 2011, pp. 1-7, XP009164429.

International Search Report for PCT/US2012/024842 mailed Dec. 5, 2012.

* cited by examiner

CATHODIC PROTECTION SYSTEM FOR MARINE APPLICATIONS

CROSS-REFERENCE TO RELATED APPLICATIONS

This utility application claims the benefit under 35 U.S.C. §119(e) of Provisional Application Ser. No. 61/491,363 filed on May 31, 2011 entitled Cathodic Protection System for Marine Applications. The entire disclosure of this provisional application is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to cathodic protections systems and more particularly impressed current cathodic protection systems for protecting structures in marine applications.

BACKGROUND OF THE INVENTION

When cathodic protection is used to protect marine structures and structures in water a variety of sacrificial and impressed current anode systems are used. Impressed current anode systems are used for applications where higher DC currents are required and for retrofits of already existing facilities such as offshore oil platforms and the wetted portions of steel and other metallic structures.

The prior art for impressed current cathodic protection marine anodes has generally been known as anode sleds. The basic concept has been to use standard anodes, such as those used for non-marine applications in their existing form and to mount the anodes on a weighted, e.g., concrete, sled of some sort. The anodes have been as simple as steel railroad rails and in recent times silicon iron anodes, graphite anodes, platinum coated anodes and mixed metal oxide anodes. The anodes have generally been in tubular form, with some use in plate form. The prior art anodes are connected to one or more cables, and because of the shape and construction of the anodes, the connection to the cables generally must be done in a factory before the anode is mounted to the sled. Most of the prior art anodes must be fully assembled and in some cases the concrete weight and support material must be cast before the anode assembly is shipped from the factory. The requirement to connect the cable and possibly cast the concrete increases the cost and shipping of the anode, and limits the flexibility of the anode cabling.

The assignee of this invention, Matcor, Inc., of Doylestown, Pa., has provided various anode assemblies for marine applications. Such assemblies are referred to as Sea-Bottom anodes and Sea-Floor anodes and use mostly solid rod and tubular anodes mounted in a vertical or horizontal direction. The anodes are part of assemblies that contain the anode to cable connections and the concrete weight material. While the concrete material can be cast in the field, it is more difficult and factory connections are recommended. The finished weight of the anode sleds can be from 1,000 to over 5,000 pounds.

Prior art anode sleds generally are more desired in heavy weights to prevent the anode sled from shifting or moving on the sea floor. If the anode sled moves easily, it can be moved great distances from the structure to be protected and damage or sever the power cable to the sled. Another concern with the marine anode sled is keeping the active anode above the sea bottom. If the anode sled sinks or is covered with mud or sand, the performance of the anode will be affected and the protective DC current may not go to the structure intended to be protected.

While the foregoing anode systems perform well, there are limitations as to their performance and durability. There are many applications where DC current output requirements can be several hundred to one thousand or more amperes of DC current. The current output of conventional tubular, rod or plate anodes is limited to the surface area of the anode. To compensate for the current limitation for each anode, more anodes and longer anodes must be used. However, additional anodes cannot be spaced too close together without creating interference between the anodes. To space the conventional anodes further apart requires larger anode sled assemblies. As a result of the foregoing, the general convention is to use additional anode sleds.

Another limitation of conventional sled-type anode assemblies is the physical resistance to the elements in the marine environment. In particular, when the prior art anode sleds are placed on the sea floor and are subjected to intense water currents, debris and ice. The DC current requirements may require an anode surface area larger than any one tubular shaped anode and it is not unusual to have two, three or more mixed metal oxide anodes, each measuring one inch in diameter and up to five feet long. The mountings for these anodes and the concrete platform needed to hold the anodes can be large and have great resistance to the water currents and therefore are subject to damage by debris and tidal action. To keep the anodes out of and above the mud on the bottom of the sea, some sleds have structures to elevate the anodes. These structures are subject to moment arm damage or float freely on a tether and the stresses with this type of installation can also cause failure.

Thus, there presently exists a need for marine anodes which overcome the disadvantages of the prior art. The subject invention addresses that need.

SUMMARY OF THE INVENTION

In accordance with one aspect of the invention there is provided an anode assembly for a cathodic protection system, e.g., an impressed current cathodic protection system, to protect a structure disposed in a body of water having a bed, e.g., the sea. The anode assembly is arranged for disposition on the bed of the body of water to protect the structure and comprises an anode, an anode support and a base. The anode assembly is arranged to be electrically connected to the cathodic protection system by an electrical conductor. The base of the anode assembly comprises a weighted member, e.g., a hollow fiberglass body filled with concrete, and is arranged for disposition on the bed of the body of water. The anode is of a spherical shape and comprises a hollow body having a spherical outer surface. The anode support is preferably a unitary member comprising an elongate member, e.g., an elongated tube, projecting upward from the base and having a top portion. The anode is mounted, e.g., welded, on the top portion of the elongate member, whereupon it is disposed above the bed of the body of water.

DETAILED DESCRIPTION OF THE PREFERRED EMBODIMENT

Figure 1:
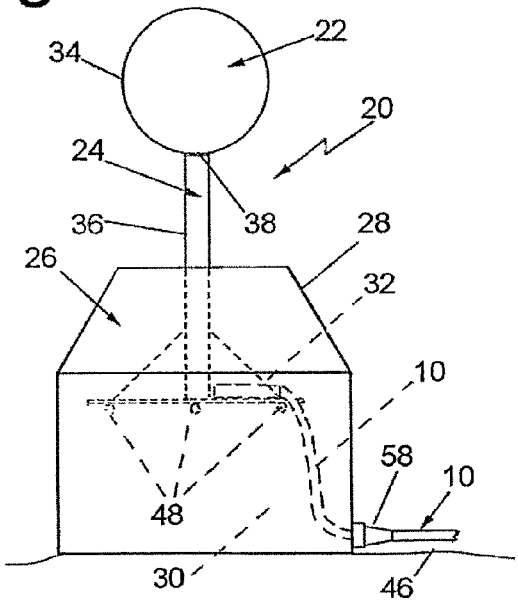
FIG. 1 is a side elevation view of one exemplary embodiment of an anode assembly constructed in accordance with this invention and shown disposed on a sea bed.

Referring now to the various figures of the drawing, wherein like reference characters refer to like parts, there is shown at 20 in FIG. 1 an anode assembly for use in an impressed current cathodic protection system (only the electrically conductive cable 10 of which is shown). That system can be used to protect any structure in a marine environment, such as off-shore drilling platforms, wharfs, piers, underwater pipelines, etc. The anode assembly 20 basically comprises an anode 22, an anode support structure 24, and a weight base or sled 26. The anode 22 is mounted at the top of the anode support structure 24. The weighted base 26 comprises a hollow member 28, e.g., a fiberglass shell or housing, into which a portion of the anode support structure is disposed, and then that hollow member is filled with a ballast, e.g., concrete 30, to form a weighted base or sled arranged for disposition on the sea bed so that the anode is located above the sea bed but within the water.

As will be appreciated by those skilled in the art from the description to follow, the anode assembly 20 of this invention is an improved and highly efficient impressed current anode system that offers many advantages over the prior art. In particular, the anode assembly very simple in construction and is easy to assembly and install at the marine location. Moreover, and quite significantly, the anode assembly includes an anode that is spherical in shape. This arrangement provides numerous advantages. For example, the spherical shape of the active anode is the most electrically efficient shape anode and creates the most surface area available in a volumetric configuration. To create the shape surface area by using a tube or flat plate (as found in conventional marine anode systems) would require much more real flat surface area. Moreover, the spherical shape of the anode of the subject invention offers the lowest physical resistance to water currents and lower risk of damage from debris in the water. Further still, the construction of the anode assembly allows for very high DC current outputs in a smaller space. Because the anode of this invention can have higher DC current ratings than conventional marine anodes now in use fewer anode assemblies can be used to protect a given structure.

As mentioned above the anode assembly 20 includes an integral support structure 24. That structure is preferably formed of a weldment composed of various titanium or other metallic components. The complete assembly of the anode with its welded titanium support structure greatly decreases the number of parts required for the anode assembly's base. Moreover, the structure of the anode assembly of this invention incorporates a receptacle or socket 32, to be described later with reference to FIGS. 5 and 6, serving as a portal for effecting the connection of the DC electric power supply cable 10 to the anode assembly 20. The construction of the connection portal is such that the connection can be made and effectively water proof sealed in the field/on site. The use of the fiberglass housing 28 that holds the metallic anode support structure 24 also serves as a mold for on-site pouring of the concrete 30 used for weight and support. In fact, the fiberglass mold can be used with a field or on-site assembled mold for additional concrete for weight or height. Lastly, installation is easier than with previous type sled anodes.

In accordance with one preferred aspect of this invention the spherical anode 22 can have a diameter of one, three or more or less feet. Moreover, it is preferred (but not mandatory) that the anode be a hollow body having a relatively thin wall thickness, e.g., 0.25 inch, and is preferably filled with an electrically non-conductive filler material, e.g., epoxy, fiberglass compound, a resin or polymer, a dense solid foam, etc., to give the anode rigidity and strength.

In the exemplary embodiment shown the anode is made of titanium and its spherical outer surface is in the form of a covering or coating of a mixed metal oxide 34, such as typically used for impressed current cathodic protection anodes. The anode base material may also be niobium or another noble metal and the active anode coating can be platinum or a platinum oxide.

Figure 3:
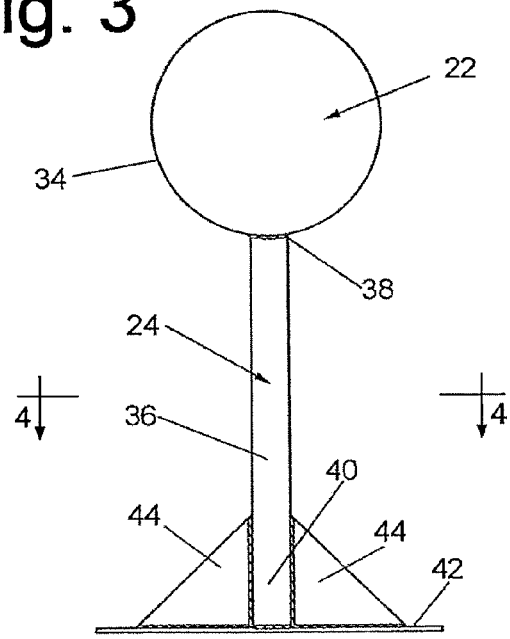
FIG. 3 is an enlarged side elevation view, partially in vertical section, of a unitary assembly of an anode and an anode support structure forming one portion of the anode assembly of FIGS. 1 and 2.
Figure 4:
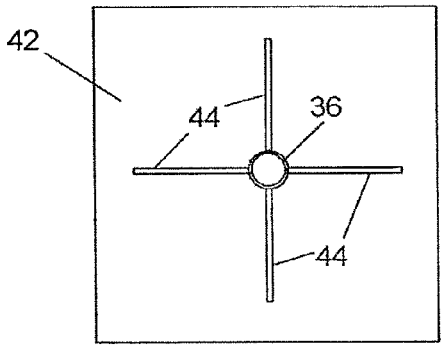
FIG. 4 is a sectional view taken along line 4-4 of FIG. 3.

As best seen in FIG. 3 the anode 22 is preferably part of a unitary assembly, e.g., a larger weldment of metallic material, such as titanium. The larger weldment includes the heretofore identified support structure 24. In the exemplary embodiment shown the support structure basically comprises an upright tubular member 36 having a top portion 38 which is fixedly secured, e.g., welded, to a bottom portion of the spherical anode 22, and a bottom portion 40 which is fixedly secured, e.g., welded to a generally planar plate 42. A plurality of gussets 44 is fixedly secured between respective portions of the tubular member 36 and respective portions of the plate 42 to provide rigidity to the support assembly. To provide additional rigidity the upright tubular member 36 may be filled with a rigidifying filler material and reinforcing rods, e.g., fiberglass rods (not shown).

Figure 2:
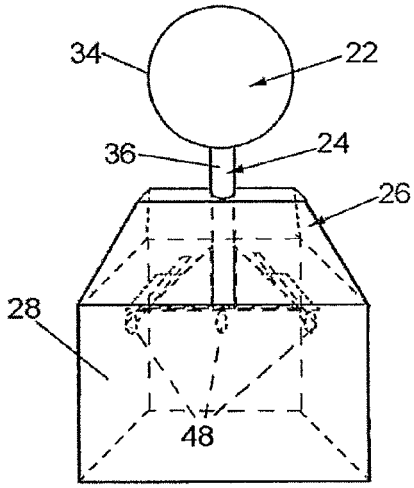
FIG. 2 is an isometric view of the anode assembly shown in FIG. 1.

In accordance with one preferred aspect of this invention the upright member 36, the plate 42 and the gussets 44 are all formed of titanium. Unlike the anode 22, they are not coated with the mixed metal oxide, since they are not desired to form a portion of the anode or to discharge current. Their sole function is to support the anode 22 a fixed distance above the sea bed 46 (FIG. 1) and be resistant to corrosion. To that end, as mentioned above, the support structure 24 is arranged to have a portion of it disposed within a hollow housing 28 forming the assembly's base 26. That housing can be of any suitable shape. In the exemplary embodiment shown it is of a generally parallelepiped shape with a tapering top portion. The top of the housing is open to enable it to be filled with concrete through that opening. In order to hold the anode support structure 24 at the desired location (height) within the housing 28, the housing includes a plurality of fiberglass members 48, e.g., rods, which project inward from the inner surface of the sidewalls of the housing. The plate 42 of the support structure 24 is disposed on these projections as best seen in FIGS. 1 and 2.

It should be noted that it is contemplated that the anode support structure 24 could be some material other than titanium, although titanium is preferred since it can be readily welded to the titanium anode 22. In particular, the support structure could be formed of steel. However, if the support structure is formed of steel a small sacrificial anode (not shown) should be provided coupled to it to prevent corrosion of the support structure in the marine environment. As will be appreciated by those skilled in the art the use of a titanium support structure eliminates the need for such a sacrificial anode, since titanium is resistant to marine corrosion. Moreover, since portions of the support structure will be embedded in cement 30 in the housing 28 of the base member 26 one would not want those portions to form any part of the electrochemical reaction, whereupon they could deteriorate the concrete. Thus, as mentioned above, the anode support structure 24 does not include a mixed metal oxide, platinum or platinum oxide coating on any of its components.

Figure 5:
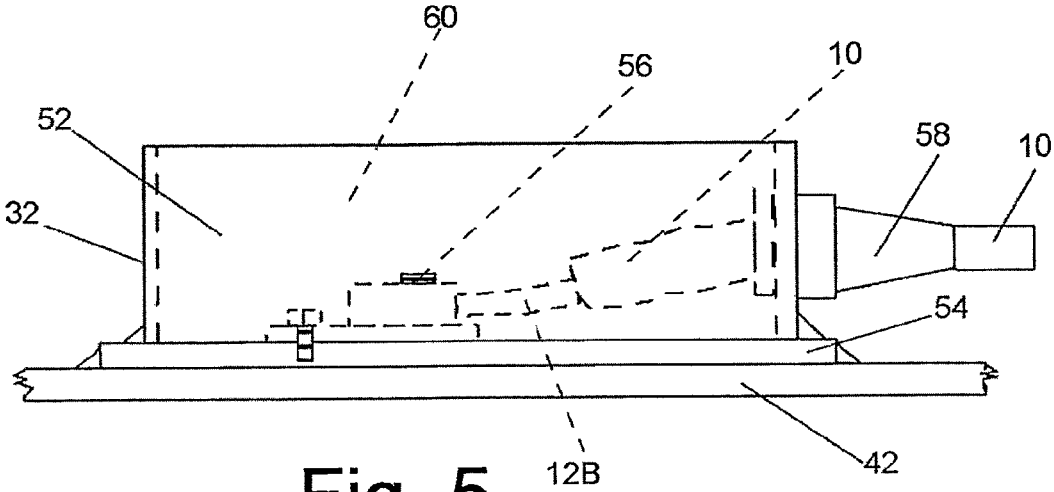
FIG. 5 is an enlarged side elevation view of a connector socket forming a portion of the anode assembly shown in FIGS. 1 and 2.
Figure 6:
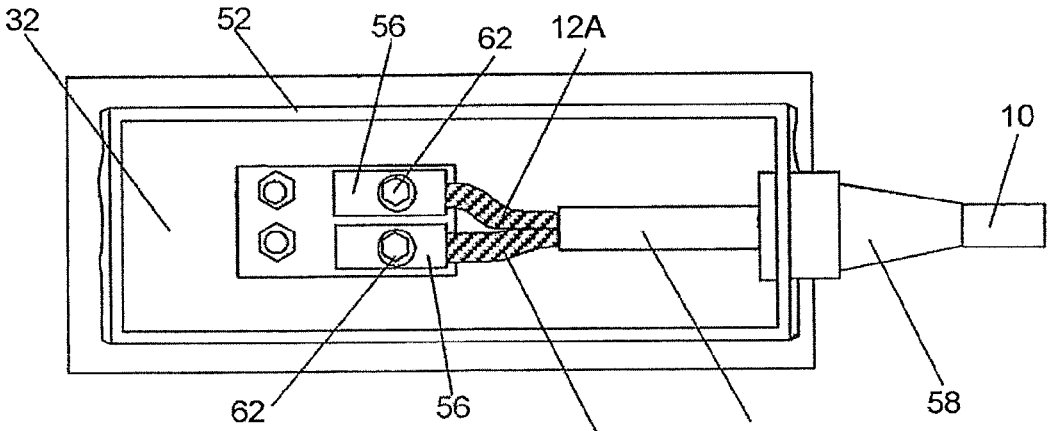
FIG. 6 is a top plan view of the connector socket shown in FIG. 5.

The anode 22 is arranged to be connected to a rectifier/transformer or DC power supply (not shown) of the impressed current cathodic protection system by the electrically conductive cable 10. To that end, as best seen in FIGS. 1, 5 and 6, the anode assembly 20 includes a special connection socket 32, which is mounted on the plate 42 of the anode support structure. The socket 32 is best seen in FIGS. 5 and 6 and basically comprises a connection box 52, a bottom mounting plate 54, a connector 56, a strain relief member 58 and a water-proofing compound 60. The box 32 if formed of titanium, although it can be of other metals or non-metallic compounds, such as fiberglass. The box is open on the top. The bottom of the box is the bottom mounting plate 54. This plate is welded to the connection box and to the base plate of the support structure 24. The connector 32 serves as the receptacle for a pair of bare copper cables 12A and 12B making up the electrically conductive cable 10, e.g., the DC supply cable. Normally the copper strands of that cable are split into two groups and placed inside the connector 32. The cables are secured and the electrical connection is made using the set screws and associated bolts 62, which are formed of titanium or other metals. If the connector is made of titanium, the connector can be welded to the bottom plate. The strain relief member 58 is mounted to the connector box and a similar strain relief member is used on the fiberglass housing 28 for the assembly and concrete. The strain relief members protect the cable 10 where it exits the connector box 52 and the fiberglass housing 28, respectively. The waterproofing compound 60 is provided to protect the electrical connections and can be an epoxy or other non-conducting and non-water absorbing compound. It is used to water proof the connection and prevent exposure of the bare cables and connectors to the elements and to corrosion.

The manner of connecting the anode and the electrical conductor (cable) 10 will now be described. To that end, the connection box 52 and connector 56 are mounted (welded) to the support structure plate 42 when the anode assembly 22 leaves the factory. A kit of the sealing compound is also included with the anode assembly. At the site, the cable is inserted through the strain relief member 48 on the fiberglass housing 28 and the end of the cable 10 is stripped to reveal a short length of its copper conductors. The strands of the copper conductors are separated into two groups 12A and 12B and inserted into the connector 56. The set screws and bolts 62 are tightened on those groups of conductors 12A and 12B to tightly grasp the conductors, thereby completing the basic electrical connection. The strain reliefs are then finished. In particular, generally, each strain relief is achieved by heating it with a torch, whereupon the strain relief member shrinks. Other types of strain relief are possible. The insulating compound 60 is then mixed and poured into the connector box 52 to fill the box with the compound.

Once the compound has set, the balance of the anode installation can be accomplished. To that end, after the anode support structure 24 has been disposed within the hollow interior of the fiberglass housing 28 and the electrical connections have been completed, the housing 28 is filled with concrete 30 in the field through its open top before installation/deployment in the water. If desired, the fiberglass base may also be mounted on an additional base (not shown) for added weight or to elevate the anode above the sea floor. The anode is placed (deployed) on the sea bed or floor and is connected to a DC electrical power supply of the impressed current cathodic protection system via the cable 10.

Without further elaboration the foregoing will so fully illustrate my invention that others may, by applying current or future knowledge, adopt the same for use under various conditions of service.

I claim:

1. An anode assembly for use in a cathodic protection system to protect a structure disposed in a body of water having a bed, said anode assembly comprising an anode, an anode support, and a base, said anode assembly being arranged to be connected to the cathodic protection system by an electrical conductor, said base of said anode assembly comprising a weighted member arranged for disposition on the bed of the body of water, said anode support comprising an elongate conductive member projecting upward from said base and having a top portion, said anode being of a spherical shape and being mounted on said top portion of said elongate member, whereupon when said anode assembly is disposed on the bed of the body of water said anode is disposed above the bed of the body of water.

2. The anode assembly of claim 1 wherein said anode comprises a hollow body having a spherical outer surface.

3. The anode assembly of claim 2 wherein said hollow body is filled with a non-conductive material.

4. The anode assembly of claim 2 wherein said anode is formed of titanium, niobium or other noble metal.

5. The anode assembly of claim 4 wherein said spherical outer surface comprises a coating of mixed metal oxide or platinum or platinum oxide.

6. The anode assembly of claim 1 wherein said anode support comprises an elongate tubular member formed of titanium, niobium or other noble metal.

7. The anode assembly of claim 2 wherein said anode and said anode support comprise a unitary assembly, and wherein said support comprises an elongate tubular member welded to said anode.

8. The anode assembly of claim 7 wherein said anode and said elongate tubular member are formed of titanium.

9. The anode assembly of claim 7 wherein said anode and said elongate tubular member are formed of niobium or other noble metal.

10. The anode assembly of claim 8 wherein said outer spherical surface comprises a coating of mixed metal oxide, platinum or platinum oxide.

11. The anode assembly of claim 9 wherein said outer spherical surface comprises a coating of mixed metal oxide, platinum or platinum oxide.

12. The anode assembly of claim 7 wherein said anode support additionally comprises a plate and plural reinforcing gussets, said plate being welded to a bottom portion of said hollow tubular member, each of said gussets being welded to a respective portion of said hollow tubular member and a respective portion of said plate.

13. The anode assembly of claim 1 wherein said base comprises a hollow body arranged to be filled with a ballast.

14. The anode assembly of claim 13 wherein said ballast comprises concrete.

15. The anode assembly of claim 13 wherein said hollow body of said base comprises fiberglass.

16. The anode assembly of claim 14 wherein said hollow body of said base comprises fiberglass.

17. The anode assembly of claim 13 wherein said anode support comprises an elongate tubular member, a plate and plural reinforcing gussets, said plate being welded to a bottom portion of said tubular member, said anode being welded to a top portion of said tubular member and each of said gussets being welded to a respective portion of said tubular member and a respective portion of said plate.

18. The anode assembly of claim 17 wherein said hollow body of said base includes plural projections forming a support surface on which said plate is disposed.

19. The anode assembly of claim 18 wherein said hollow body of said base is filled with concrete.

20. The anode assembly of claim 19 wherein said hollow body of said base comprises fiberglass.

21. The anode assembly of claim 1 additionally comprising a connection socket adapted to have the electrical conductor connected thereto.

22. The anode assembly of claim 21 wherein said anode support comprises an elongate tubular member and a plate, said plate being welded to a bottom portion of said tubular member, said anode being welded to a top portion of said tubular member, and wherein said connection socket is located on said plate.

23. The anode assembly of claim 22 wherein said connection socket comprises a box having a connector therein.

24. The anode assembly of claim 23 wherein said connection socket additionally comprises a strain relief member arranged to be coupled to the electrical conductor.

25. The anode assembly of claim 24 additionally comprising a waterproofing compound disposed within said box.

* * * * *